US006095375A

United States Patent [19]

Adams et al.

[11] Patent Number: 6,095,375

[45] Date of Patent: Aug. 1, 2000

[54] DUST COVER ATTACHMENT FOR PUSH-PULL CAP

[75] Inventors: Brian M. Adams, Newark; Rodger A. Moody, Castro Valley, both of Calif.

[73] Assignee: Portola Packaging, Inc., San Jose, Calif.

[21] Appl. No.: 09/153,813

[22] Filed: Sep. 15, 1998

[51] Int. Cl.[7] ..... B67D 5/06

[52] U.S. Cl. ..... 222/182; 222/525

[58] Field of Search ..... 222/562, 525, 222/182; 215/318; 220/289

[56] References Cited

U.S. PATENT DOCUMENTS

| | | | |
|---|---|---|---|
| 4,230,230 | 10/1980 | Mumford | 222/182 |
| 4,781,311 | 11/1988 | Dunning et al. | 222/562 |
| 5,104,008 | 4/1992 | Crisci | 222/153 |
| 5,328,063 | 7/1994 | Beck et al. | 222/525 |
| 5,465,876 | 11/1995 | Crisci | 222/153.1 |
| 5,699,924 | 12/1997 | Mascio et al. | 215/252 |
| 5,813,575 | 9/1998 | Glynn et al. | 222/525 |

*Primary Examiner*—Philippe Derakshani
*Attorney, Agent, or Firm*—Julian Caplan; Flehr Hohbach Test Albritton & Herbert LLP

[57] ABSTRACT

Dust covers enclose the upper end of the push-pull bottle cap, the spout cap and the seal which projects through the central hole in the spout cap. The cap is formed with a neck over which the lower end of the dust over fits. The interior of the cover is formed with a plurality of short thread sections (e.g., eight). Above the thread sections is a circumferential locking bead. The cap neck is formed with a plurality of short protrusions (e.g., four) which mesh with the cover thread sections and a circumferential groove above the protuberances into which the locking bead seals. The cover may be pushed down without rotation to seat on the neck and also may be pulled up without rotation for removal. Alternatively, the cover may be twisted on or off, the protuberances meshing with the thread sections when the cover is in closed position its interior is sealed from entry of "wash down" water.

4 Claims, 6 Drawing Sheets

DUST COVER ATTACHMENT FOR PUSH-PULL CAP

CROSS-REFERENCE TO RELATED APPLICATIONS

This application is a continuation-in-part of the applicants' application filed simultaneously herewith entitled Dust Cover Spout Closure, applicants' attorneys' file number A-66953/JC.

BACKGROUND OF THE INVENTION

1. Field of the Invention.

This invention relates to a new and improved dust cover for push-pull cap. More particularly the invention relates to the combination of a spout for a bottle, a push-pull spout cap slidable thereon and a dust cover which encloses the spout cap and the upper portion of the bottle cap.

2. Related Art

Push-pull bottle caps of this general type are illustrated and described in U.S. Pat. Nos. 5,104,008; 5,465,876; and 5,699,924. The use of dust covers for such push-pull caps is also well known in the art.

The present invention, however, retains the dust cover in place on the neck of the bottle cap by means of an internal wash down seal fitting into an external groove on a neck of the cap. The dust cover may be tightened in place and removed either by snapping it on or off the neck or by twisting the cap so that threads on the interior thereof are engaged by protruberences (or complementary helical engagement structure) on the cap neck. It will be understood that the helical engagement structure located on the cover may be located on the cap and vice-versa if desired.

SUMMARY OF THE INVENTION

A plastic cap is applied to the upper end of a plastic bottle and may be held thereon by a tamperevidencing band connected to the bottom of the cap skirt by bridges which, when broken, indicate tampering with the contents. The upper open end of the cap supports a seal which extends above the lip of the upper end of the cap.

Slidable in a "push-pull" fashion relative to the upper end of the cap is a spout cap which has a central hole which seals with the cap seal when the spout cap is pushed down and which is removed from the seal when the spout cap is pulled up. The spout cap has internal vertically spaced beads which engage the exterior of the spout stem in sliding fashion so that the spout cap may move between a downward sealed position and an upward extended position. Optionally, a second tamper-evidencing band may be attached to the spout cap and connected therewith by bridges which, when broken, indicate initial opening of the package.

Fitting over and around the spout and the upper end of the bottle cap is a dust cover which has a collar adjacent its lower end formed with an internal wash down seal bead which seals in a corresponding groove in the cap neck to prevent wash water, which is often sprayed over closed push-pull containers from entering the inside of the dust cover.

The dust cover collar is also formed with short thread segments which may be engaged by outward projections on the cap collar. The relationship of the projections and threads of the cap collar and the dust cover collar is such that most users can press the dust cover down and pull it off. However, in instances where the user cannot perform these operations, the cover may be twisted relative to the cap so that the projections on the cap collar engage treads on the interior of the dust cover collar either to secure the cover in down position or loosen it from the bottle cap.

BRIEF DESCRIPTION OF THE DRAWINGS

The accompanying drawings, which are incorporated in and form a part of this specification, illustrate embodiments of the invention and, together with the description serve to explain the principles of the invention.

DETAILED DESCRIPTION OF THE PREFERRED EMBODIMENT

Figure 1:
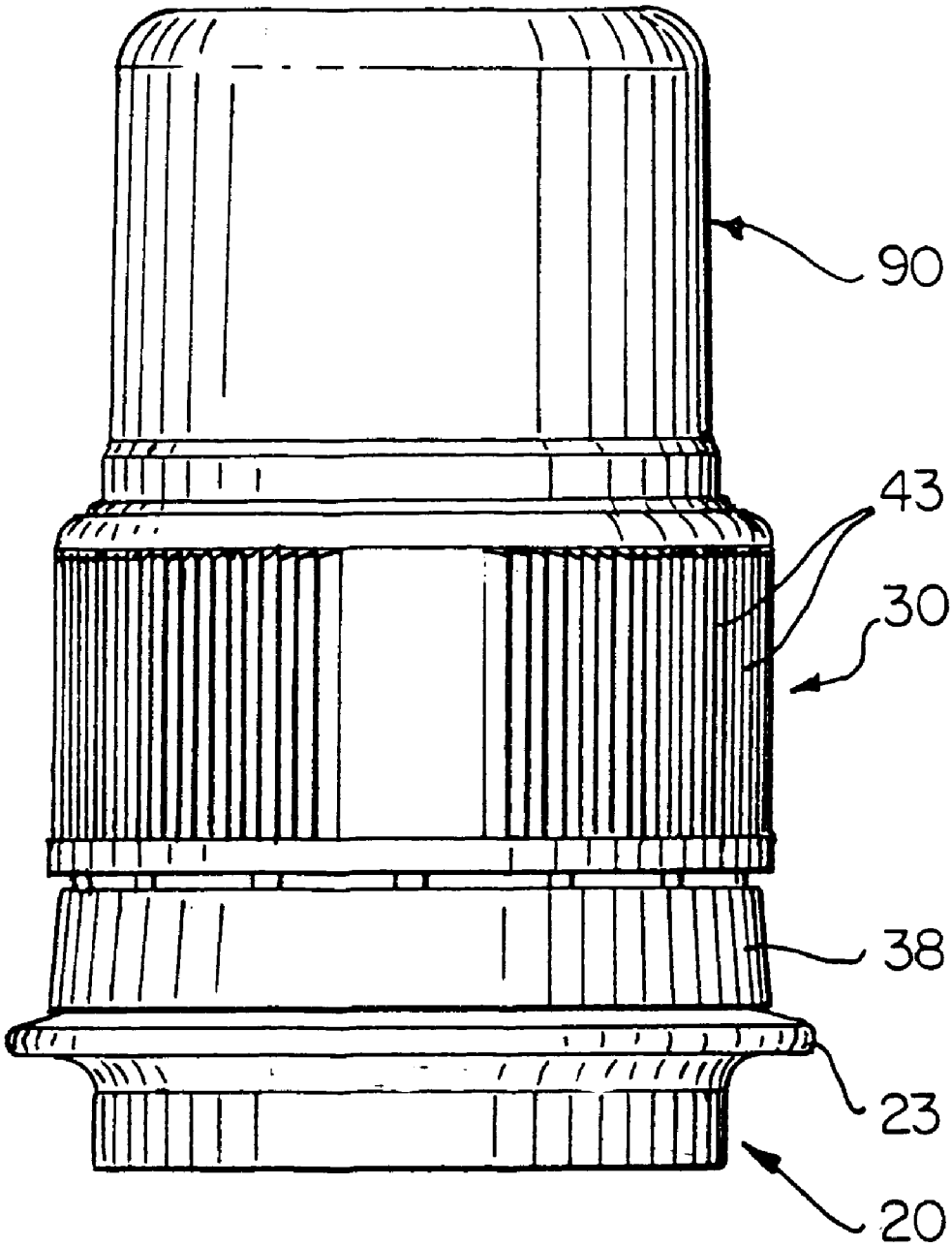
FIG. 1 is a side elevational view of the upper end of a bottle and the cap and dust cover of the present invention.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The present invention relates to "push-pull" bottle closures used for individual dispensing of water, juices and other liquids. A dust cover which encloses the upper end of the cap is removable. A spout or stem cap on the upper end of the bottle cap is held in place by a tamper-evident band. Upon breaking the connection between the stem cap and the band the stem cap may be pulled upward permitting liquid to stream out. By pushing the stem cap down, dispensing of liquid ceases. The present invention relates to features of such push-pull caps and more particularly of the dust cover which users usually replace when liquid is not being dispensed.

The bottle 20 with which the cap is used is subject to wide variation. As iliused in FIG. 2, such a bottle has a neck 21 terminating in a lip 22. Gripper ring 23 is used in filling and handling bottles 20. In the form of bottle illustrated, external threads 24 are formed adjacent lip 22. Other means to hold the cap on the bottle may be employed, as well understood in this art. Below threads 24 is an external circumferential locking ring 26 having a shoulder 27 on its bottom surface to engage an optional tamper-evidencing band.

Fitting over and extending above neck 21 is cap 30. Cap 30 has a skirt 31 which fits over the upper end of neck 21 and is formed with internal threads 32 which mate with threads 24. Above threads 32 is an inward extending approximately horizontal first shoulder 33 which terminates in an upward extending first neck 34, in the embodiment shown, having approximately the same internal diameter as neck 21. On the underside of shoulder 33 are first and second lip seal rings 36, 37 which are very flexible and form a liquid tight seal with the lip 22.

Below the bottom edge 42 of skirt 31 is tamper-evident band 38 which is somewhat downward-outward tapering, the lower end of band 38 engaging the upper surface of gripper ring 23. Locking segments 39 are formed on the inside of band 38, the number and spacing of segments 39 being subject to variation. The segments 39 engage under shoulder 27 of locking ring 26 and prevent cap 30 from being removed from bottle 20 so long as the bridges 41 which interconnect band 38 and skirt 31 are intact. The breaking of bridges 41 indicates to the consumer that the contents of the bottle 20 may have been subject to tampering. Since bottles 20 are frequently refilled by the consumer, flutes 43 are formed on the exterior of skirt 31 to facilitate turning cap 30.

Figure 4:
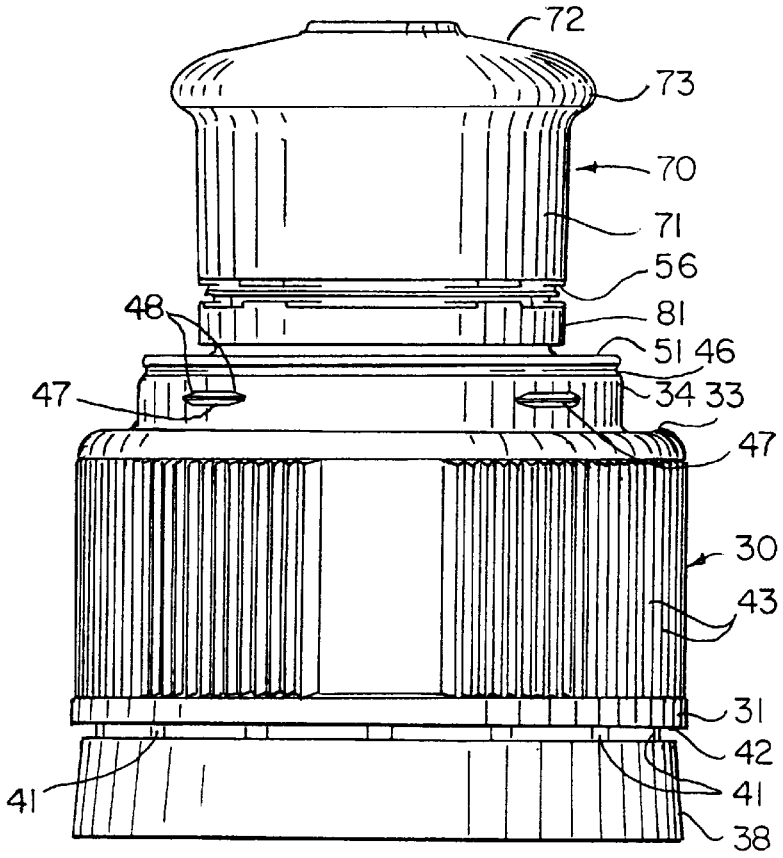
FIG. 4 is a side elevational view of the cap and the spout cap in assembled condition.

Neck 34 is formed with external elements which interact with dust cover 90 as hereinafter explained. Essentially, the external elements are a wash down seal groove 46 adjacent the upper end of first neck 34 and a plurality of protrusions 47 (here shown as four in number). Protrusions 47 engage internal threads on the dust cover and, in order to facilitate mating of protrusions 47 with the dust cover threads, the ends 48 of the protrusions 47 are tapered in diameter and in width as best shown in FIG. 4. While protrusions 47 are shown as horizontal, they could be elongated and disposed at an angle to the horizontal. It is understood that other forms of helical engagement structure may be used.

Figure 3:
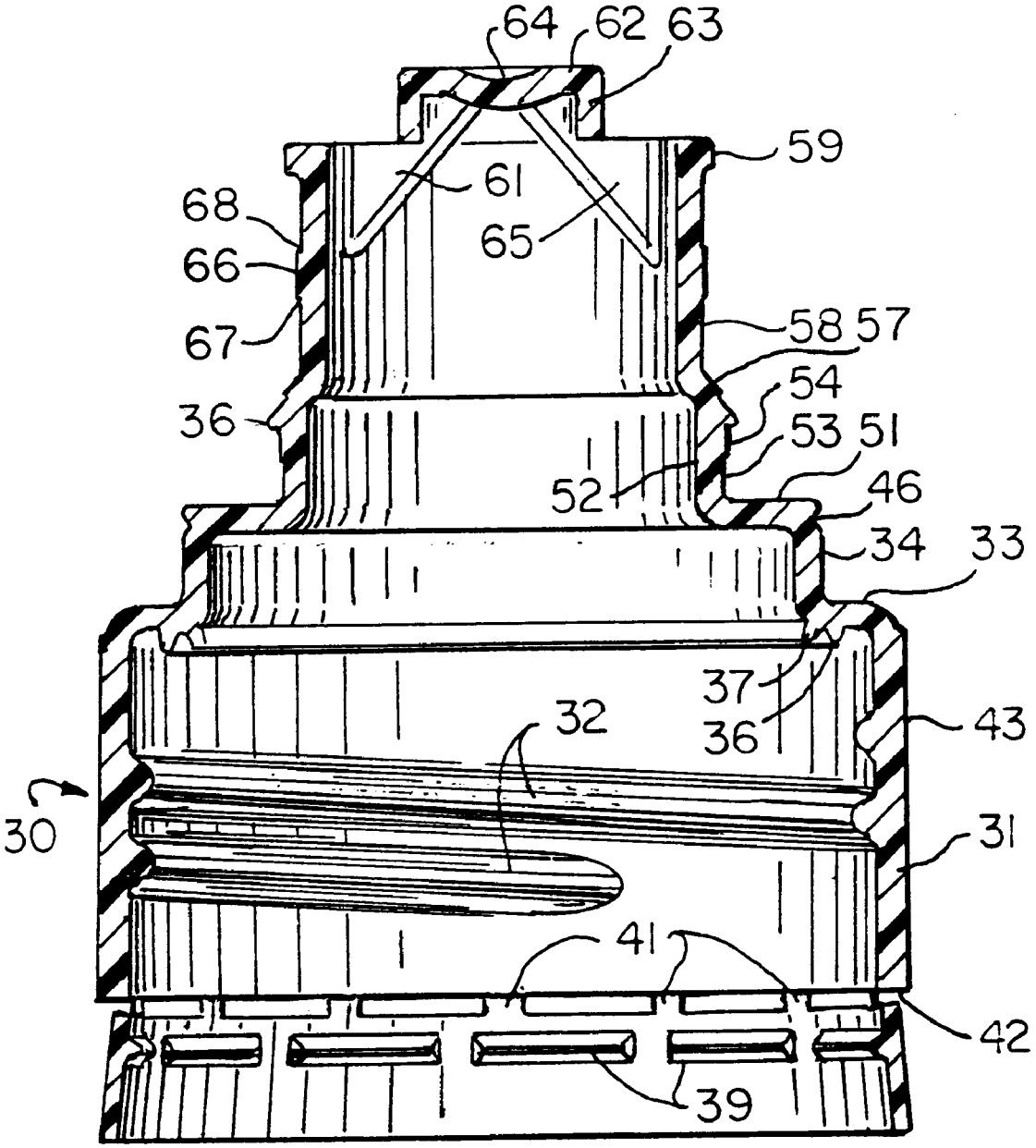
FIG. 3 a vertical sectional view through the cap.

Above first neck 34 is an approximately horizontal, inward extending second shoulder 51 which terminates in a vertical second neck 52. The exterior of neck 34 immediately above shoulder 51 has a reduced diameter portion 53 and thereabove is slightly enlarged diameter portion 54. Above portion 54 are one or more circumfere projections 56 which, as best shown in FIG. 3, tapers downwardly-outwardly. Second neck 52 cooperates with a spout cap tamper-evident band as hereinafter explained.

Above second neck 52 is an inwardly upwardly tapered portion 57 and there-above is vertical stem 58 which has an external lip 59 on its upper end.

Slanting upwardly-inwardly from approximately the mid-level of stem 58 are struts 61, here shown as three in number. Fixed on the upper ends of struts 61 is seal 62 which has a downward extending skirt 63 and a central dimple 64 in its top surface. The spaces between stem 58 and seal 62 permit dispensing of liquid.

Approximately midway of the length of the exterior of stem 58 is an enlargement 66. Lower and upper shoulders 67, 68 are located on the lower and upper ends of enlargement 66.

Figure 2:
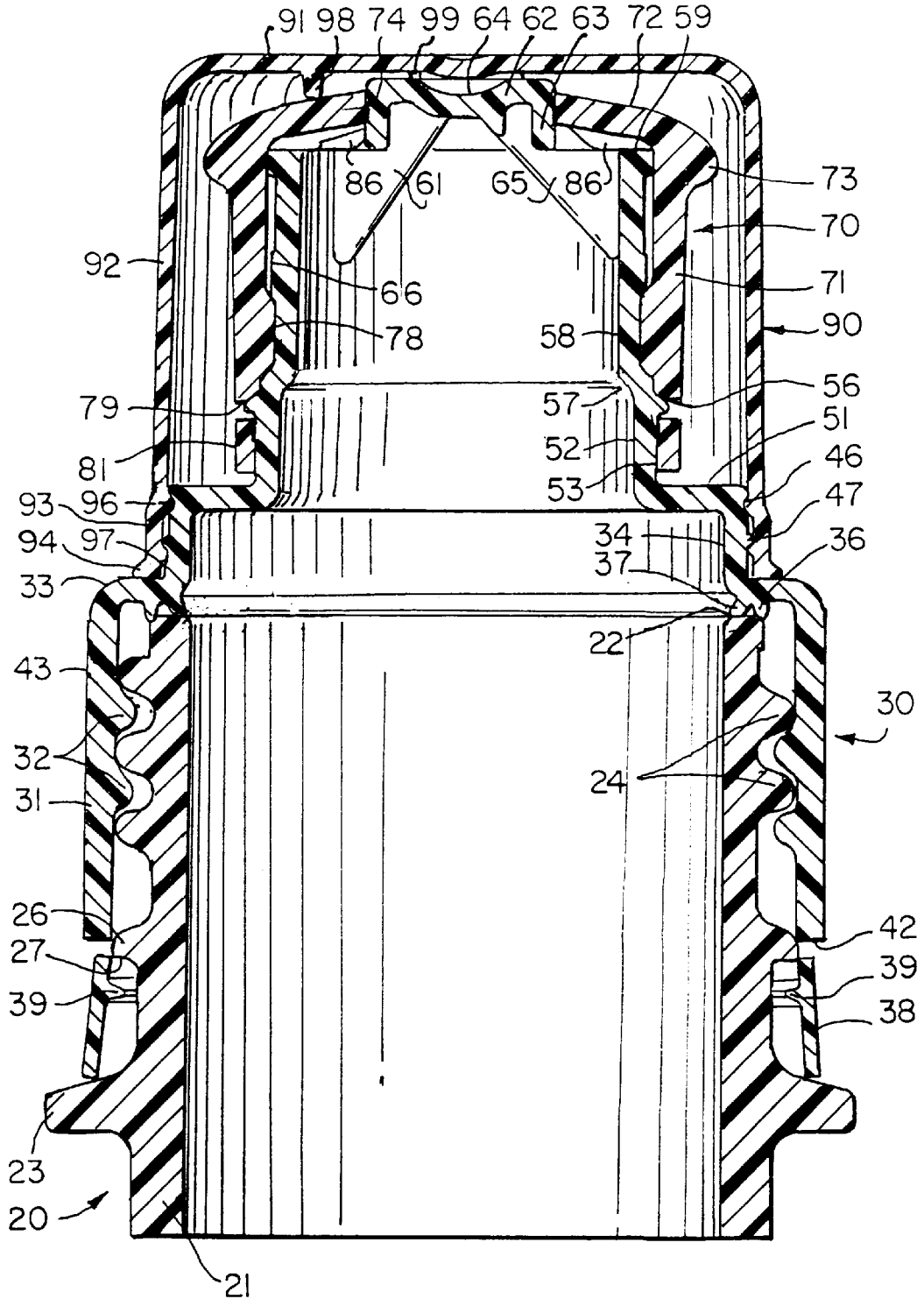
FIG. 2 is an enlarged vertical mid-sectional view through the structure of FIG. 1.
Figure 5:
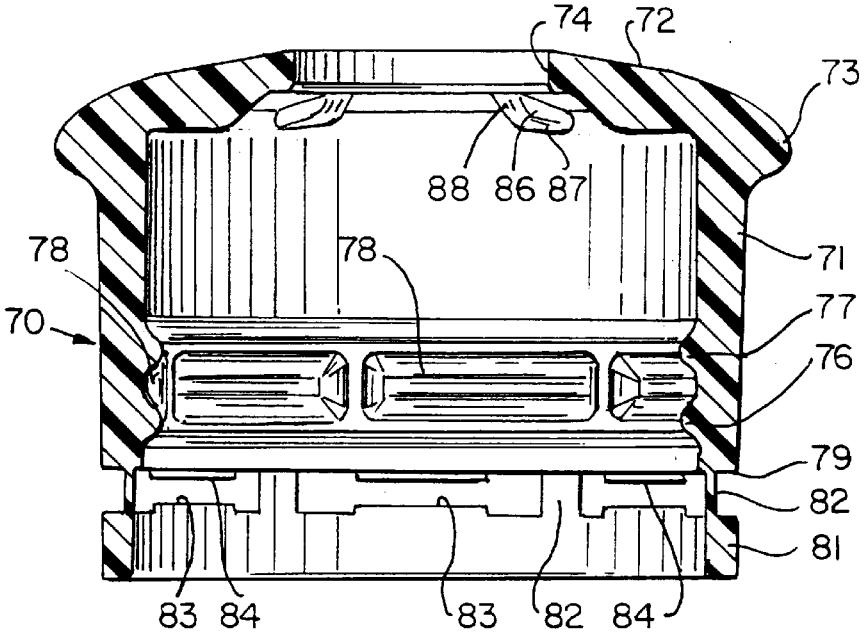
FIG. 5 is an enlarged vertical sectional view through the spout cap.
Figure 6:
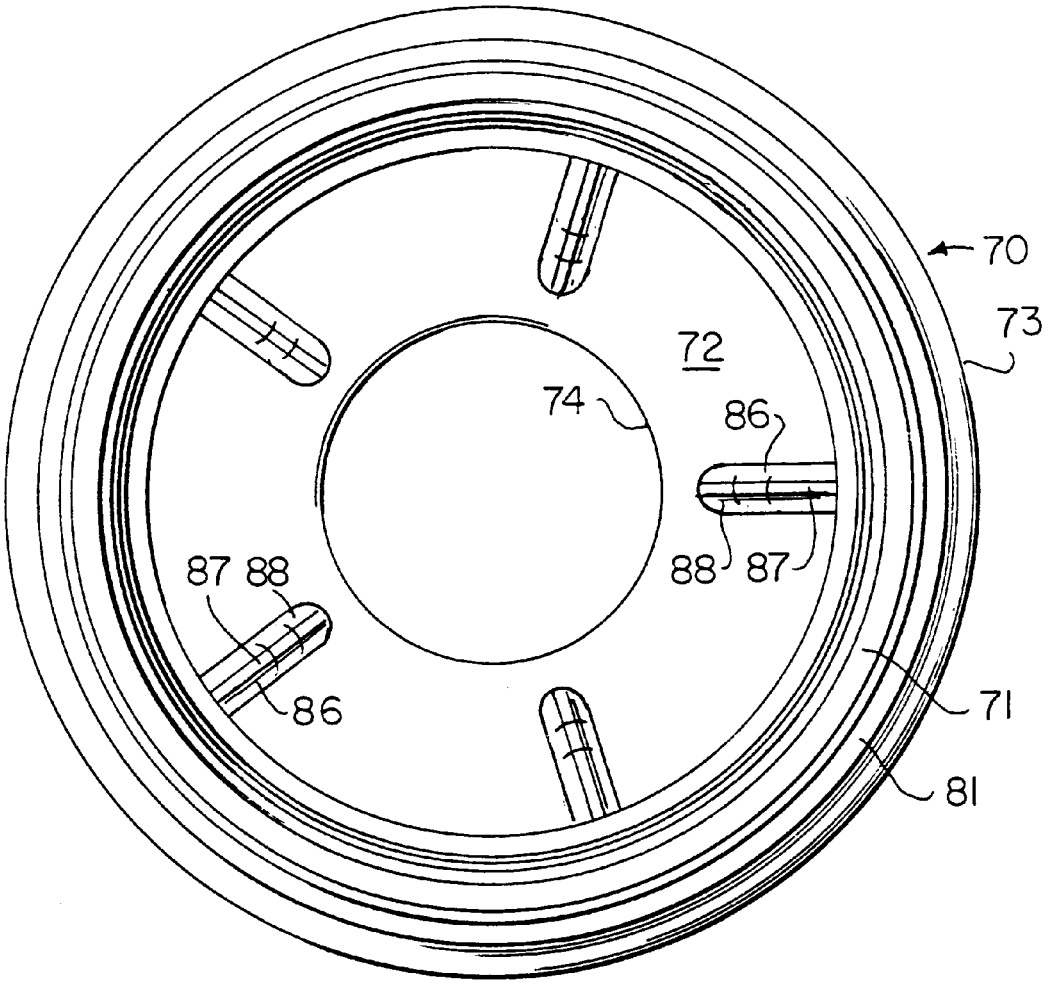
FIG. 6 is a bottom plan view of the structure of FIG. 5.
Figure 7:
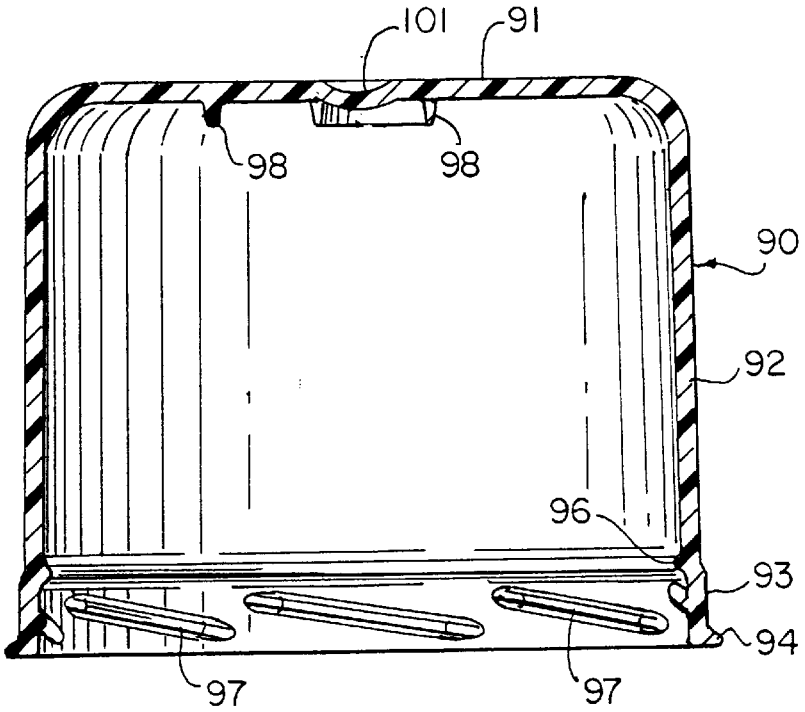
FIG. 7 is a vertical sectional view through the dust cover.

Vertically slidable on stem 58 is spout cap 70. Cap 70 has a skirt 71 which fits over stem 58 and has an annular upwardly domed top 72 formed with an external grip 73 and a central hole 74 having an internal diameter to seal with the external diameter of skirt 63. A vertically spaced pair of annular beads 76, 77 are formed on the interior of skirt 71 as best shown in FIG. 5 and beads 76 an 77 are interconnected by circumferentially spaced vertical ribs 78. On the underside of domed top 72 are stops 86, here shown as five in number. Each stop 86 has a horizontal inwardly extending shoulder 87 and an upwardly inwardly slanted portion 88 inward of shoulder 87. As best shown in FIG. 2, the function of stops 86 is to engage lip 59 and limit downward movement of cap 70.

A second tamper-evident band 81 may be formed on cap 70 and connected to the bottom edge 79 of skirt 71 by bridges 82, here shown as six in number. Bridges 82 are bowed outwardly by projections 56. A series of spaced upward extending platforms or bumpers 83 are formed on the upper edge of band 81 and matching downward extending platforms or bumpers 84 in vertical alignment with platforms 83 are formed on the bottom edge 79 of skirt 71. Reference is made to U.S. Pat. No. 5,699,924 for explanation of the structure and function of these features.

If a tamper-evident band 81 is used on the spout 70, the bridges 82 are first broken by pulling the cap 70 upward or by twisting it so that the projections 56 break the bridges 82. In order to lift cap 70, the user pulls grip 73 upward. The cap 70 then rises upward from the position shown in FIG. 2 until upper bead 77 engages lip 59. By reason of the presence of enlargement 66 on stem 58 the upward movement is a snap action which may produce a distinctive snap sound. Upward movement of cap 70 causes hole 74 to move above the level of seal 62. Hence, liquid can be dispensed through hole 74. The cap 70 is closed by pushing downward, the lower bead 76 engaging tapered portion 57, again with a distinctive snap action and sound.

Dust cover 90 has a horizontal top 91 and a skirt 92 extending downward from the periphery of top 91. At the bottom of skirt 92 is a slightly enlarged collar 93 having a bottom end 94 which seats against first shoulder 33 when the cover is in place (see FIG. 2). On the inside of skirt 92 is a seal bead 96 which seals into groove 46. It will be understood that after bottles 20 are initially filled, the bottler frequently washes the complete assembly down and in such cases it is desirable that no wash water leak into the interior of the dust cap 90. Below seal bead 96 are internal helical engagement structure or threads 97 here shown as having eight leads. Each thread section 97 is approximately straight and short, disposed at an angle to the horizontal.

The dust cover 90 may be manually applied and removed from the cap 30 by a straight downward push and an upward pull. However, in some instances the pulling and pushing movements may be difficult for the user. In such cases the dust cover may be twisted relative to the cap and in those instances protrusions or second helical engagement structure 47 interengage threads 97 so that by turning the cover 90 in the proper direction it may be screwed onto or screwed off cap 30.

Figure 8:
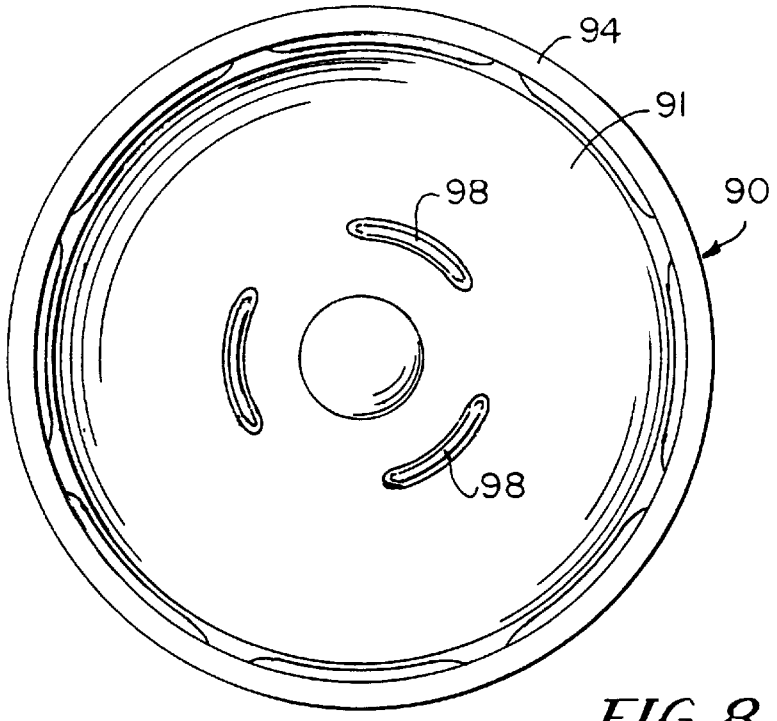
FIG. 8 is a bottom plan view of the structure of FIG. 7 in reduced scale.

As best shown in FIG. 8, on the underside of top 91 are arcuate downward projections 98, here shown as three in number and each extending over an arc of approximately 45°. When the dust cover 90 is either pushed onto or screwed onto cap 30, the projections 98 engage the upper surface of top 72 and ensure that the spout cap 70 is fully depressed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claim is:

1. In combination a push-pull cap and a dust cover, said push-pull cap being of the type having a cap first skirt structured for attachment of said push-pull cap to a bottle, said first skirt having a neck; a spout stem above said first skirt, a spout cap having a second skirt slidable in push-pull manner along said stem, said spout cap top being formed with a hole, said spout stem supporting a seal for said hole, said spout cap having a closed position with said seal closing said hole and a open position with said seal displaced from said hole, said dust cover having a cover top, a cover skirt depending from said cover top, and a collar on an end of said cover skirt remote from said cover top, the improvement comprising, internal engagement structure on said collar and second engagement structure on said neck complementary to said internal engagement structure whereby twisting said cover in first direction raises cover relative to said push-pull cap, said internal engagement structure comprising a thread and said second structure comprising protuberances and in which said threads and protuberances are formed and dimensioned whereby said cover may be pushed onto said neck and into locked position without rotative movement relative to said cap and whereby said cover may be pulled off said neck without rotative movement relative to said cap and which further comprises a seal groove extending circumferentially around said neck and an internal seal bead extending circumferentially around said collar mating with said seal groove to prevent ingress of moisture between said cover and said spout cap.

2. The combination of claim 1 in which each said protuberance is approximately 10° of arcuate length and is tapered inwardly at either end.

3. The combination of claim 1 in which when said bead is seated in said groove said protuberances may be located in non-mating position relative to said threads.

4. The combination of claim 1 in which said internal engagement structure is helical.

* * * * *